US005722499A

United States Patent [19]

Nguyen et al.

[11] Patent Number: 5,722,499

[45] Date of Patent: Mar. 3, 1998

[54] MULTIPLE DIAMOND LAYER POLYCRYSTALLINE DIAMOND COMPOSITE CUTTERS

[75] Inventors: David M. Nguyen, Houston; Michael A. Siracki, The Woodlands; Stephen G. Southland, Humble, all of Tex.

[73] Assignee: Smith International, Inc., Houston, Tex.

[21] Appl. No.: 518,037

[22] Filed: Aug. 22, 1995

[51] Int. Cl.[6] ..... E21B 10/46

[52] U.S. Cl. ..... 175/431; 175/434

[58] Field of Search ..... 175/434, 428, 175/432, 420.1; 51/295, 307, 308, 309; 76/108.2, 108.4

[56] References Cited

U.S. PATENT DOCUMENTS

| | | | |
|---|---|---|---|
| 4,225,322 | 9/1980 | Knemeyer | 175/434 X |
| 4,255,165 | 3/1981 | Dennis et al. | 175/434 X |
| 4,268,276 | 5/1981 | Bovenkerk | 175/434 X |
| 4,604,106 | 8/1986 | Hall et al. | 175/434 X |
| 5,119,714 | 6/1992 | Scott et al. | 51/293 X |
| 5,549,171 | 8/1996 | Mensa-Wilmot et al. | 175/431 |

*Primary Examiner*—Frank Tsay
*Attorney, Agent, or Firm*—Christie, Parker & Hale, LLP

[57] ABSTRACT

An improved polycrystalline diamond composite ("PDC") cutter comprises a single or a plurality of secondary PDC cutting surfaces in addition to a primary PDC cutting surface. The two cutting surfaces are spaced apart, resulting in enhanced cutter efficiency and useful life. The primary PDC cutting surface is a polycrystalline diamond layer on an exposed end face of the cutter. A secondary cutting surface is formed by a polycrystalline diamond layer embedded within the body of the cutter. The secondary cutting surface can have a larger diameter than the primary cutting surface so that the forward end of the cutter parallels rock formation during drilling and both cutting surfaces engage the rock formation.

12 Claims, 2 Drawing Sheets

MULTIPLE DIAMOND LAYER POLYCRYSTALLINE DIAMOND COMPOSITE CUTTERS

BACKGROUND

The present invention relates to polycrystalline diamond composite cutters ("PDC") used in drag bits for drilling bore holes in earth formations.

PDC cutters are well known in the art. They have a cemented tungsten carbide body and are typically cylindrical in shape. The cutting surface of the cutter is formed by sintering a polycrystalline diamond ("PCD") layer to a face of the cutter. The diamond layer serves as the cutting surface of the cutter. The cutters are inserted on a drag bit outer body 8 exposing at least a portion of the cutter body 10 and the diamond cutting surface 14 as shown in FIG. 1.

Typically, the cutter makes contact with a formation at an angle, i.e., the diamond cutting layer is at an angle to the formation surface. As the bit rotates, the PDC cutting layer edge makes contact and "cuts" away at the formation. At the same time portions of the exposed cutter body also make contact with the formation surface. This contact erodes the cutter body. As the carbide body of the cutter erodes, less and less carbide material is available to support the diamond cutting layer, resulting in the eventual detachment and loss of the PDC cutting layer. Consequently, the cutter is disabled.

Furthermore as the PDC cutter erodes the cutter which is tightly fitted into the bit loosens and falls out. As the cutting process continues, the fallen cutter can come in contact with or lodge against the remaining cutters causing them to also fail. PDC cutters may also fail by spalling of the PCD layer, delamination, impact fractures of the layer or the like.

Accordingly, there is a need for a cutter with increased resistance to body wear and erosion so as to prevent the detachment of the PDC cutting layer and the consequential "fall-out" of the cutter. There is also a need for a cutter which can still function after the diamond cutting layer is detached. Such a cutter will have an enhanced useful life resulting in less frequent cutter changes and in fewer drilling operation stoppages for replacing failed cutters.

SUMMARY OF THE INVENTION

An improved polycrystalline diamond composite drag bit cutter comprises multiple cutting surfaces, at least two of which are non-abutting, resulting in an enhanced useful life. Generally, PDC cutters have a cylindrical shape. The cutting surface of a PDC cutter is formed by sintering polycrystalline diamond to the PDC cutter face. With the present invention secondary cutting surfaces are formed on the body of the PDC cutter. These cutting surfaces are formed by sintering a layer of polycrystalline diamond within the cutter body.

A drag bit comprises a plurality of generally cylindrical cemented tungsten carbide polycrystalline diamond cutters having two end faces, wherein the cutters are inserted in an outer body of the bit so that a portion of each cutter including an end face is exposed. At least a portion of such cutters comprise a primary polycrystalline diamond cutting surface on the exposed end face and a secondary polycrystalline diamond cutting surface on the exposed portion of the cutter. The secondary cutting surface is spaced apart from the primary cutting surface and in some embodiments has a larger diameter than the primary cutting surface.

DETAILED DESCRIPTION

The present invention is an improved polycrystalline diamond composite cutter ("PDC") comprising multiple polycrystalline diamond ("PCD") cutting surfaces, at least two of which are non-abutting, resulting in enhanced cutter useful life and increased cutter efficiency.

Generally PDC cutters have a carbide body 10 having a cylindrical shape with a cutting face 12. A PCD layer 14 is sintered on the cutting face of the cutter. While the present invention is described herein based on a cylindrical-shaped cutter, the invention is equally applicable to other shapes of cutters. In the present invention, the PCD layer forms a primary cutting surface. One or more additional cutting surfaces (referred herein as "secondary" cutting surfaces) are formed on the PDC carbide body. These secondary cutting surfaces can span the whole or a portion of the circumference of the cutter body.

To form a secondary cutting surface in practice of this invention, a second layer of polycrystalline diamond is formed in the cutter body spaced apart from the end layer of PCD that forms the primary cutting surface.

A PCD cutter is made by placing a body of cemented tungsten carbide adjacent to a layer of diamond crystals in a high temperature, high pressure press. After processing at a temperature and pressure where diamond is thermodynamically stable, the resulting cutter has a layer of polycrystalline diamond bonded to the end face of the carbide body.

Figure 2:
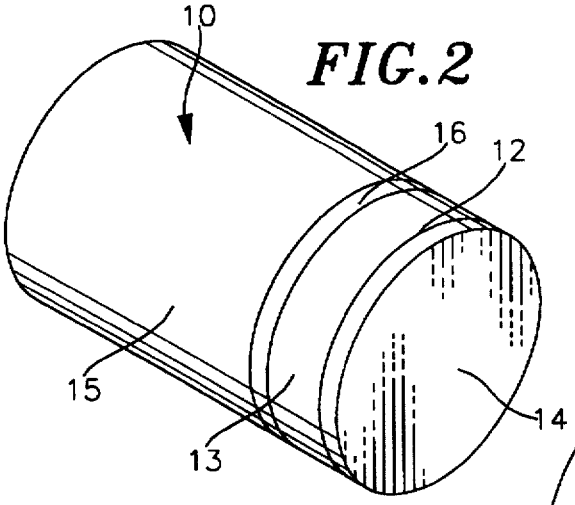
FIG. 2 is an isometric view of a PDC cutter with a ring-shaped secondary PDC cutting surface.

To make a PDC cutter having a secondary cutting surface as illustrated in FIG. 2, there are two bodies of cemented tungsten carbide 13, 15, one of which 13 may be in the form of a relatively thin disk whereas the other body 15 is a longer cylinder. A layer of diamond crystals is placed between the two bodies of cemented tungsten carbide and a layer of diamond crystals is placed adjacent to the end of the thinner disk. When subjected to high temperature, high pressure processing, the resulting cutter has a layer 14 of polycrystalline diamond on one end face forming a primary cutting surface. A second layer 16 of polycrystalline diamond is embedded in the cutter between the two bodies of cemented tungsten carbide and forms a secondary cutting surface. The secondary cutting surface is in the form of a layer 16 which is parallel to the primary cutting surface, and spans the cross section of the cutter.

Figure 3:
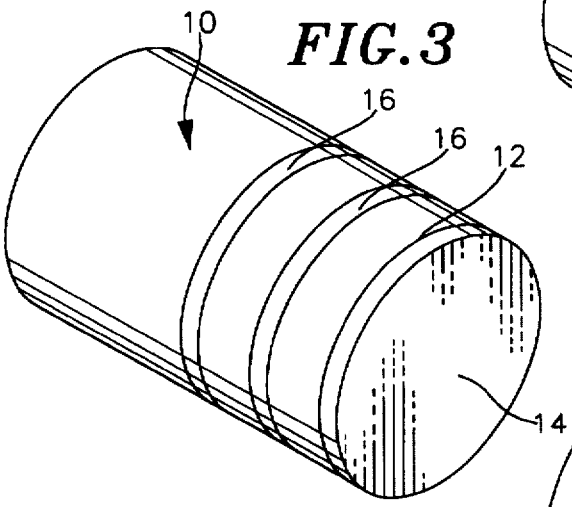
FIG. 3 is an isometric view of a PDC cutter with a plurality of ring-shaped secondary PDC cutting surfaces.

If desired, multiple secondary layers 16 as illustrated in FIG. 3 span the cross section of the cutter body to provide a plurality of secondary cutting surfaces.

Figure 4:
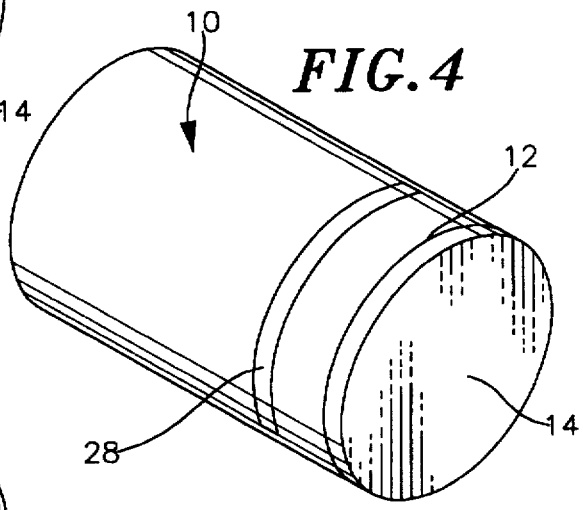
FIG. 4 is an isometric view of a PDC cutter with a half-ring-shaped secondary PDC cutting surface spanning half of the cutter circumference.

Alternatively, a secondary layer spans half of the cross section of the cutter body and is parallel to the primary PDC cutting surface as illustrated in FIG. 4. The exposed surface of such a half layer is on the exposed part of the cutter when mounted in the rock bit body. Extra erosion resistance and a secondary cutting edge are not needed within the bit body.

A secondary cutting surface serves several purposes. First, it can serve as an additional cutting surface, increasing the cutting efficiency of the cutter. Second, it delays the erosion and wear of the cutter body that occurs when the cutter body is allowed to make contact with the earth formation during drilling. In the event the primary cutting surface is broken or eroded during use, the secondary cutting surface remains as a back up. The secondary layer in the body of the cutter may, in extreme situations, serve to minimize propagation of a crack through the carbide body. For any of these reasons, the life of the cutter is enhanced and early failure of the bit may be avoided.

Figure 1:
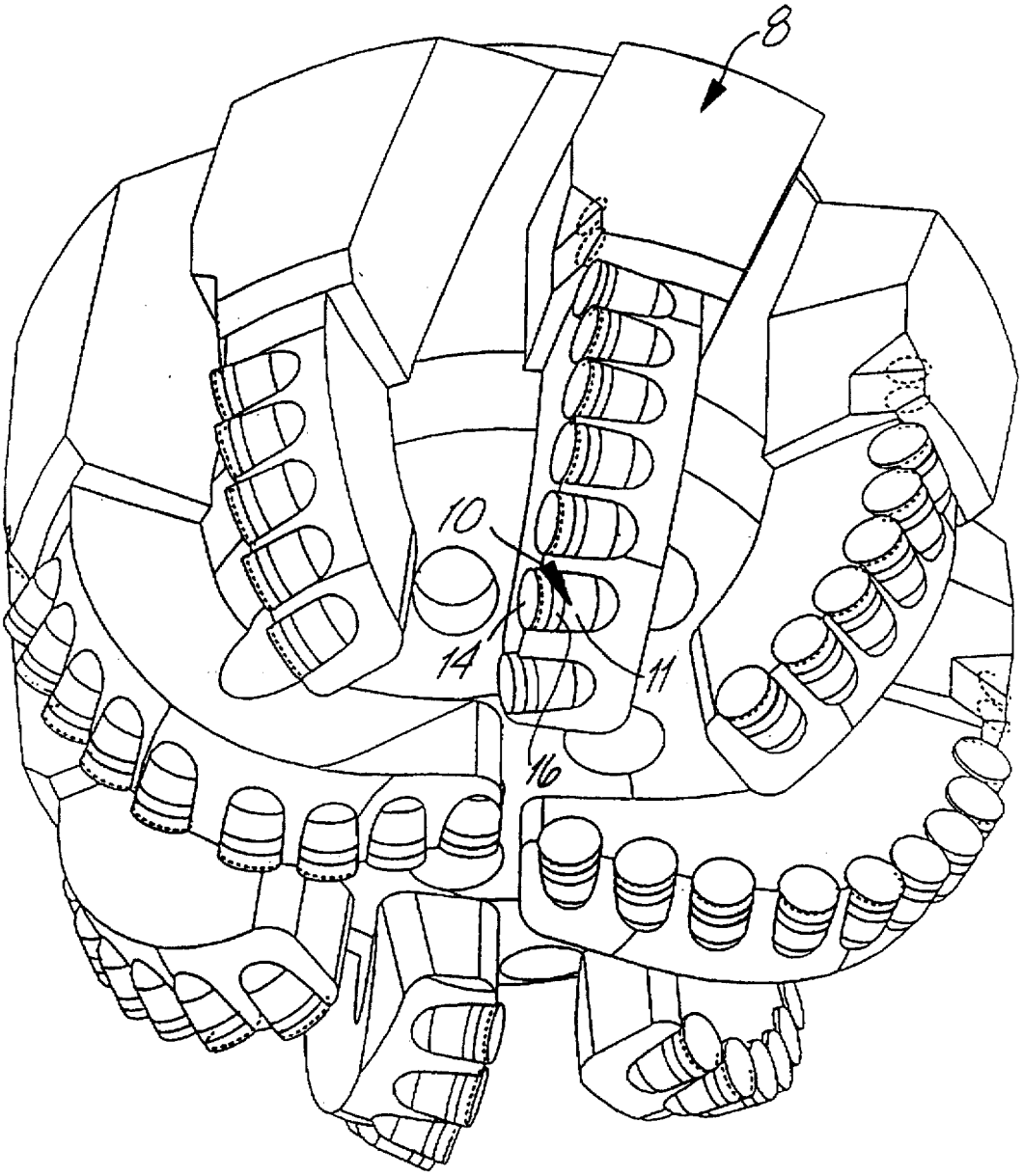
FIG. 1 is an isometric view of a drag bit with installed PDC cutters having primary and secondary cutting surfaces.

PDC cutters are generally inserted on a drag bit outer body at an angle, exposing the primary cutting surface 14 and a portion 11 of the cutter body 10. Typically, the cutters are inserted on the bit outer body so that the longitudinal axis of each cutter is approximately perpendicular to a radius of the bit as shown in FIG. 1. As the bit rotates during the drilling process, the primary PCD cutting surface 14 makes contact with the formation first, followed by contact of the exposed cutter body portion 11. With the present invention, contact of the primary cutting surface with the earth formation is followed by contact of the secondary cutting surface which is formed on the cutter exposed outer surface. As the secondary cutting surface makes contact with the formation, it prevents the portion of the exposed cutter body surrounding the secondary cutting surface from making contact with the formation and, therefore, slows down the cutter body erosion.

As a result, the period of time it takes for the cutter body to wear down to a point where the primary PDC cutting surface 14 detaches from the cutter is prolonged, resulting in enhanced cutter life. Furthermore, the retardation of cutter body erosion ensures that cutters remain tightly fitted into the cutter bit longer, decreasing the frequency of cutter "fall-out." In addition, with this improved PDC cutter, even if the primary PDC cutting layer detaches or fails, the cutter can still function (i.e., cut) using the secondary cutting surfaces.

Figure 5:
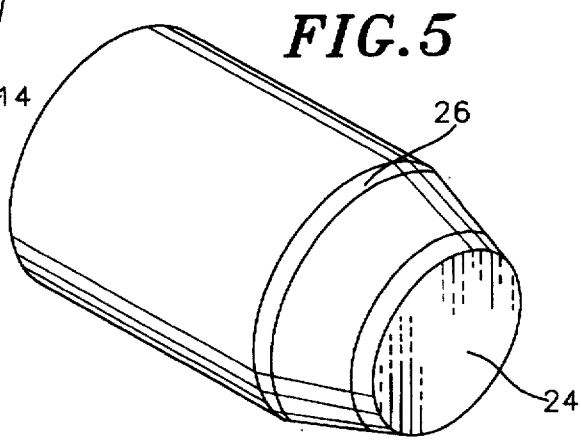
FIG. 5 is an isometric view of a PDC cutter with a secondary cutting surface having a larger diameter than its primary cutting surface.

As has been mentioned, the PDC cutters are mounted in the drag bit body at an angle so that there is negative back rake as the primary cutting surface engages the rock formation. FIG. 5 illustrates another embodiment of PDC cutter suitable for mounting at an angle in the drag bit body. In this embodiment there is a primary cutting surface 24 at the exposed end of the PDC cutter, spaced apart from the layer of polycrystalline diamond forming the primary cutting surface. There is another layer of PCD 26 embedded within the cemented tungsten body of the cutter forming a secondary cutting surface.

The secondary cutting surface has an outside diameter corresponding to the diameter of the rearward or base portion of the cutter body. Forwardly of the secondary surface, the body is in the form of a truncated cone with a smaller diameter adjacent to the layer 24 forming the primary cutting surface. Thus, the primary cutting surface has a smaller diameter than the diameter of the secondary cutting surface. The angle of taper on the conical portion of the generally cylindrical cutter is approximately parallel to the angle at which the cutter is placed in the drag bit body. Thus, as the cutter engages the rock formation during drilling, the primary and secondary cutting surfaces are both in a position to engage the formation simultaneously. Cutting occurs at both surfaces without waiting for the primary cutting surface to erode or break to the point where the secondary surface is exposed.

The secondary cutting layer may the same as or different from the primary cutting layer. It may be thicker or thinner. It may have tungsten carbide particles embedded in the composite material for greater toughness and closer match to the coefficient of thermal expansion and modulus of the cemented tungsten carbide.

If desired, a layer of cemented tungsten carbide may be formed on the front face of the primary layer for enhanced toughness.

The two cemented tungsten carbide bodies used to form the cutter body may be the same or different in composition, toughness and wear resistance for enhancing performance of the cutter.

Cutters enhanced with a secondary cutting surface may be employed on the gage row of cutters on a drag bit where wear and impact loading is more severe and more conventional cutters employed in inner rows of cutters.

Those skilled in the art will recognize many other modifications and substitutions to the elements of the embodiments disclosed herein. For example, a secondary cutting surface may also be employed on a cylindrical compact brazed to a cutter stud as used in some types of rock bits. Polycrystalline cubic boron nitride may be employed instead of diamond on such cutters. Such modifications and substitutions are within the scope of the present invention as defined in the following claims.

What is claimed is:

1. A drag bit comprising a plurality of cylindrical cemented tungsten carbide polycrystalline diamond cutters having two end faces, a body therebetween and a longitudinal axis, wherein the cutters are inserted in an outer body of the bit so that the longitudinal axis of each cutter is approximately perpendicular to a radius of the bit and wherein a portion of each cutter including an end face is exposed, and comprises:

a primary polycrystalline diamond cutting surface on the exposed end face; and a polycrystalline diamond composite layer forming a secondary cutting surface on the exposed portion of the cutter, wherein the diamond layer extends across the cutter body and wherein the secondary cutting surface is spaced apart from the primary cutting surface.

2. A drag bit as recited in claim 1 wherein at least a portion of the cutters are generally cylindrical with the secondary cutting surface having a diameter larger than the diameter of the primary cutting surface.

3. A drag bit as recited in claim 1 wherein the secondary cutting surface comprises a layer of polycrystalline diamond embedded in the cutter parallel to the end face forming the primary cutting surface.

4. A drag bit as recited in claim 1 wherein each insert is mounted in the bit at a predetermined rake angle and wherein at least a portion of the cutters comprise a cylindrical rearward portion and forward portion in the form of a truncated cone, the larger diameter of the cone being adjacent to the secondary cutting surface and the smaller diameter of the cone being adjacent to the primary cutting surface, the cone having a taper angle approximately equal to the predetermined rake angle.

5. A PDC cutter as recited in claim 1 wherein the polycrystalline diamond layer extends across only a portion of the body of the cutter.

6. A PDC cutter for insertion into a drag bit at a predetermined angle, the cutter comprising:

a body of cemented tungsten carbide comprising a cylindrical rearward portion and a forward portion in the form of a truncated cone wherein the forward portion tapers to smaller diameter end face at an angle approximately equal to the predetermined angle;

a first polycrystalline diamond composite layer on the smaller diameter end face of the cone; and a second polycrystalline diamond composite layer within the body and spaced from the first layer, wherein the larger diameter of the cone is nearer to the second layer than the first layer.

7. A PDC cutter as recited in claim 6, wherein the second layer extends only across a portion of the cutter body.

8. A PDC cutter as recited in claim 6 comprising a plurality of secondary cutting surfaces spaced apart from each other and from the primary cutting surface.

9. A PDC cutter for insertion in a drag bit at a predetermined angle, the cutter comprising:

a body having a cylindrical rearward portion and a truncated cone shaped forward portion having a cutting face, wherein the forward portion tapers at an angle approximately equal to the predetermined angle; and a polycrystalline diamond layer on the cutting face forming a primary cutting surface, and polycrystalline diamond extending around at least a portion of the circumference of the body proximate the larger diameter of the truncated cone shaped forward portion forming a secondary cutting surface, wherein the secondary cutting surface is spaced apart from the primary cutting surface.

10. A PDC cutter as recited in claim 9 wherein the secondary cutting surface spans the entire circumference of the cutter body.

11. A PDC cutter as recited in claim 9 wherein the secondary cutting surface spans only a portion of the circumference of the cutter.

12. A PDC cutter as recited in claim 9 further comprising a plurality of PDC secondary cutting surfaces each spanning at least a portion of the circumference of the cutter and each spaced apart from each other and from the primary cutting surface.

* * * * *